US010197267B2

(12) United States Patent
Gries et al.

(10) Patent No.: US 10,197,267 B2
(45) Date of Patent: Feb. 5, 2019

(54) SPLIT PASS ECONOMIZER BANK WITH INTEGRATED WATER COIL AIR HEATING AND FEEDWATER BIASING

(71) Applicant: Babcock & Wilcox Power Generation Group, Inc., Barberton, OH (US)

(72) Inventors: Jeffrey J. Gries, Munroe Falls, OH (US); Larry A Hiner, Orrville, OH (US); William R Stirgwolt, Wadsworth, OH (US)

(73) Assignee: THE BABCOCK & WILCOX COMPANY, Barberton, OH (US)

( * ) Notice: Subject to any disclaimer, the term of this patent is extended or adjusted under 35 U.S.C. 154(b) by 148 days.

(21) Appl. No.: 13/754,030

(22) Filed: Jan. 30, 2013

(65) Prior Publication Data

US 2013/0192542 A1 Aug. 1, 2013

Related U.S. Application Data

(60) Provisional application No. 61/593,556, filed on Feb. 1, 2012.

(51) Int. Cl.

| | |
|---|---|
| ***F22D 1/38*** | (2006.01) |
| ***F22D 1/02*** | (2006.01) |
| ***F22D 1/36*** | (2006.01) |

(52) U.S. Cl.

CPC ..... *F22D 1/38* (2013.01); *F22D 1/02* (2013.01); *F22D 1/36* (2013.01)

(58) Field of Classification Search

CPC ..... F22D 1/02; F22D 1/36; F22D 1/38; F22D 1/325

USPC ..... 122/421, 406.1, 420

See application file for complete search history.

(56) References Cited

U.S. PATENT DOCUMENTS

| | | | | |
|---|---|---|---|---|
| 4,160,009 | A * | 7/1979 | Hamabe | B01D 53/8631 122/4 D |
| 5,299,534 | A * | 4/1994 | Janka | 122/477 |
| 2004/0045513 | A1* | 3/2004 | McNertney et al. | 122/441 |
| 2007/0261647 | A1* | 11/2007 | Albrecht et al. | 122/406.1 |
| 2010/0229805 | A1* | 9/2010 | Cerney et al. | 122/406.4 |

* cited by examiner

*Primary Examiner* — Steven B McAllister
*Assistant Examiner* — Benjamin W Johnson
(74) *Attorney, Agent, or Firm* — Michael J. Seymour

(57) ABSTRACT

An apparatus for using a water coil air heater with a single bank economizer. A boiler economizer arrangement includes an economizer bank which has separate hot pass bank and cold pass bank economizer portions in a parallel arrangement, each facing the same flow of hot flue gas. Feedwater enters the cold pass bank economizer where it is heated by the hot flue gas, and then flows to a water coil air heater away from the hot flue gas. The feedwater dissipates heat energy in the water coil air heater which may be used to heat air bound for combustion. The feedwater continues into the hot pass bank economizer portion of the economizer arrangement where it absorbs additional heat from the flue gas. The heated feedwater flows out of the economizer arrangement and may be subject to additional heating by a boiler or other heat exchanger.

8 Claims, 5 Drawing Sheets

SPLIT PASS ECONOMIZER BANK WITH INTEGRATED WATER COIL AIR HEATING AND FEEDWATER BIASING

CROSS-REFERENCE TO PRIORITY APPLICATION

This application claims the benefit of U.S. provisional Application No. 61/593,556 filed Feb. 1, 2012. U.S. Provisional Patent Application No. 61/593,556 filed Feb. 1, 2012 is hereby incorporated by reference in its entirety.

FIELD AND BACKGROUND OF THE INVENTION

The present invention relates generally to boiler economizers for maximizing heat transfer from hot products of combustion to water, and in particular to economizer bank arrangements where hot banks and cold banks are arranged next to each other so that a water coil air heater (WCAH) can be used without requiring multiple banks in series relative to the gas flow.

Economizers and air heaters perform key functions in energy generation by increasing overall boiler thermal efficiency by recovering energy from flue gas before it is exhausted to the atmosphere. Typically for each 40 F (22 C) that the flue gas is cooled by an economizer—sometimes in conjunction with an air heater—overall boiler efficiency can increase by about 1%. Economizers typically recover energy by using heat from partially-cooled flue gas to preheat feedwater before the feedwater continues on to a boiler for further heating. Water heated in an economizer can also, optionally, be routed through an air heater.

Air heaters preheat combustion air to enhance the combustion of many fuels. For example, supplying preheated air is critical for pulverized coal firing. It contributes to drying coal and to promoting stable ignition. Recycling heat into a furnace via an air heater is another a way of increasing boiler efficiency by reducing the amount of heat energy vented to the atmosphere.

In comparison to furnace water walls, superheaters, and reheaters, economizers and air heaters normally require a large amount of heat transfer surface per unit of heat transferred. This is because of the relatively small difference between the temperature of the (already significantly cooled) flue gas and the temperature of the feedwater and/or the combustion air, which receives the heat. Normally heated flue gas from a heat source, such as a furnace, first passes through superheaters and/or other heat transfer devices before reaching an economizer. By the time the flue gas reaches the economizer, it has already passed much of its original peak heat energy to other heat transfer devices, so its temperature becomes lower. The purpose of the economizer is to harvest and recycle what excess heat remains.

Economizers are primarily heat transfer surfaces used to preheat boiler feedwater before it enters, for example, a drum or a furnace surface, depending on the boiler design. Economizers typically include a number of tubes. The tubes may have fins or other structures to increase their heat absorption from gas passing over the tubes. The term "economizer" comes from early use of such heat exchangers to reduce operating costs or economize fuel usage by recovering extra energy from flue gas. Economizers also reduce the potential of thermal shock, drum level fluctuations, and water temperature fluctuations entering boiler drums or water walls.

Economizers can be used in a variety of applications, including various types of power plants and boilers, including process recovery boilers used in the paper pulp manufacturing industry. The standard practice has been to arrange long flow economizer surfaces across the full width of a boiler or other spaces where heated gas is routed.

To further improve efficiency (by increasing water to flue gas temperature differentials), heat can be removed from economizer feedwater via the addition of a WCAH in the feedwater flow path between separate cold and hot economizer banks. The WCAH improves economizer performance by removing and recycling some heat from the circulating water within the economizer process, thereby increasing the water to gas temperature differential when the water enters a successive (hotter) economizer bank. This increased temperature differential increases total heat absorption by the circulating water, and that increased heat absorption increases boiler efficiency more than the efficiency of an economizer without a WCAH unit. See FIG. 1, which shows a typical prior art arrangement of a cold bank economizer 22, a WCAH 30, and a hot bank economizer 24. In this arrangement, feedwater enters a cold bank economizer 22 at a feedwater inlet 40. While passing through cold bank economizer 22 feedwater absorbs heat energy from the flue gas flow 4 as the flue gas flows through the cold bank economizer 22. Feedwater subsequently flows through a WCAH 30, wherein a portion of the heat energy absorbed from the cold bank economizer is rejected to an air stream. The cooled feedwater subsequently absorbs additional heat energy from the flue gas flow 4 as the flue gas flows through the hot bank economizer 24. The air heated by the WCAH 30 can, for example, be used to improve fuel ignition and combustion in a furnace.

A problem with the prior art design shown in FIG. 1 is that it requires two full long flow economizer banks placed in series relative to the gas flow 4. Notice that each bank spans all or nearly all of the distance between the first side economizer wall 6 and the second side economizer wall 8 across the path of the flue gas flow 4. The first side economizer wall 6 and second side economizer wall 8 enclose the economizer banks. Thus, without at least two separate long flow economizer banks, a WCAH 30 cannot be installed in the feedwater flow path between cold and hot banks. See also FIG. 2 (showing a perspective drawing of a prior art economizer with a single continuous collection header fed by many mini-headers) and FIG. 3 (a plan view of a prior art wall-to-wall cold bank economizer).

A WCAH can theoretically be installed upstream or downstream of a single bank economizer, but will offer only nominal boiler efficiency improvement if it is not between two economizer banks in the feedwater flow path. A WCAH cannot, however, be installed at an intermediate location using a single traditional long flow (e.g. mini-header) type economizer bank. This is because the typical mini-header design feeds the mini headers 28 with continuous (inlet and outlet) collection headers 26, as shown in FIGS. 2 and 3. There is no practical location to integrate a WCAH 30 using the prior art collection headers, particularly since the WCAH 30 must be placed outside of the hot flue gas flow, typically outside the boiler wall, to function.

At the same time, it is often not practical or desirable to install two full separate economizer banks spanning the gas flow path as shown in FIG. 1. In some cases, using two separate banks in series is impractical or requires too much space, particularly when a pre-existing space is being refitted. Installing two separate full economizer banks can also add unwanted expense.

Thus, there is a need for economizer arrangements that allow the use of a water coil air heater with only a single bank economizer, with the hot and cold economizer banks in parallel, relative to the gas flow, and without the need for two economizer banks in series, relative to the gas flow.

SUMMARY OF THE INVENTION

This invention solves the above prior art problems by placing economizer hot and cold bank passes in parallel relative to the gas flow, instead of in series, in a side-by-side arrangement across a flow of hot flue gas. A WCAH is placed outside of the hot gas stream, preferably in a separate cool air stream. The WCAH is part of a feedwater flow path and is installed downstream of the cold pass economizer bank and upstream of the hot pass economizer bank with regard to the flow of feedwater. Cold and hot pass economizer "banks" may also be referred to as cold and hot pass economizer "sections".

Steam generators and boilers use heat to convert water into steam for a variety of applications. When the heat results from a combustion process, the energy in the hot combustion flue gases needs to be transferred into the water to increase its temperature, eventually converting the water into steam. Economizers are basically tubular heat exchangers used to preheat the boiler feedwater. They perform a key function in recovering low level (i.e., low temperature) energy from the flue gas before it is released to the atmosphere.

An economizer typically comprises one or more banks of tubes (also referred to as banks of heat transfer surfaces) placed in the flue gas stream. The terms "series" and "parallel" are often used by boiler designers to describe the arrangement of the surfaces with respect to the flue gas temperature entering or leaving a bank. For example, two or more banks of economizer are located in "parallel" with respect to the flue gas when the average temperature of the flue gas entering such banks is about the same. The flue gas temperature exiting from such banks will depend upon the relative amounts of heating surface in each bank and the amount of water flowing therethrough. Similarly, two or more banks of economizer are in "series" with respect to the flue gas when the flue gas temperature exiting from an upstream (with respect to a direction of flue gas flow) bank is the entering flue gas temperature for a downstream (with respect to a direction of flue gas flow) bank.

In a preferred arrangement, a single economizer bank including at least two separate (hot pass and cold pass) banks in parallel across a hot flue gas flow path. The average temperature of the flue gas entering such banks is about the same. The arrangement splits the gas flow within the single economizer bank, with part of the flow heating one section of the bank and the remainder of the flow heating another section of the same bank. See, for example, FIG. 4 where part of the flue gas flow 4 flowing through this section of the cavity 2 passes through the cold bank economizer 22, and another portion of the flue gas flow 4 passes through the hot bank economizer 24. The distance between the cold bank economizer 22 and hot bank economizer 24 in the schematic diagram of FIG. 4 appears greater than it would be in many preferred embodiments where there would be only minimal space between the cold and hot bank economizers 22, 24, respectively.

The arrangement includes an intermediate WCAH 30 arranged to cool feedwater between the cold and hot economizer banks 22, 24. This parallel arrangement provides increased thermal effectiveness combined with smaller space requirements. This is an improvement over prior art economizers which could only utilize the energy efficiency advantages of a WCAH 30 if multiple economizer banks were used in series, as shown in FIG. 1, where the flue gas temperature exiting from an upstream (with respect to a direction of flue gas flow) bank is the entering flue gas temperature for a downstream (with respect to a direction of flue gas flow) bank. A preferred embodiment allows the feedwater flow to be biased between economizer banks and the WCAH 30 by using valves 44.

In the present arrangement, when the feedwater returns to the hot bank from the WCAH it can better absorb heat from the flue gas because the feedwater temperature has been lowered. The use of a WCAH between economizer passes improves boiler efficiency significantly more than arrangements that use an economizer without a WCAH, or where water only flows through a WCAH only before or after all of the economizer passes. The improved arrangement of economizer banks in parallel allows for the addition of a WCAH when there is insufficient space to install two long flow economizer banks in series (with respect to gas flow 4, as in FIG. 1), or to avoid the extra expense of installing two banks in series.

With the improved design, a WCAH can be installed at an intermediate location on a single long flow (mini-header) type economizer bank. A preferred design utilizes a split collection header instead of a single continuous collection header spanning the entire width of the economizer bank. The split collection header allows the single bank to act as two banks (cold pass and hot pass) while providing a location between the collection headers to route feedwater away from the economizer bank, through WCAH, and ultimately back to the second, hot economizer bank. See FIGS. 4-5.

The arrangement provides design and operational flexibility. Beyond single longflow economizers, it can also be applied to a variety of other heat transfer configurations (horizontal tube economizers, multiple banks of long flow economizers, etc.) in combination with WCAH's to achieve desired outlet conditions. The arrangement is not limited to longflow economizers. The multiple gas path, split bank with intermediate WCAH concept can be applied, for example, to most boiler economizer arrangements.

One embodiment of the invention is a boiler economizer arrangement comprising a cavity for routing heated flue gas, the cavity having side walls including a first economizer side wall and a second economizer side wall, wherein the first and second economizer side walls are opposite each other. The cavity has an upstream direction which receives a stream of heated flue gas and a downstream direction for exiting flue gas.

An economizer bank stretches most or all of the way from the first economizer side wall to the second economizer side wall. The economizer bank includes a plurality of sections including at least a cold pass bank economizer and a hot pass bank economizer. The cold pass bank economizer and the hot pass bank economizer are positioned in a parallel arrangement such that each bank receives a different portion of the stream of heated flue gas flow. The economizer may be designed so that the cold pass bank economizer abuts one side wall while the hot pass bank economizer abuts the other opposite side wall.

One embodiment of the present invention is drawn to a boiler economizer arrangement comprising: a cavity for conveying heated flue gas flow, the cavity including a first economizer side wall and a second economizer side wall, wherein the first and second economizer side walls are opposite each other; the cavity having an upstream direction which receives a stream of heated flue gas flow, and a downstream direction for exiting flue gas flow; an economizer bank stretching substantially from the first economizer side wall to the second economizer side wall, the economizer bank comprising a plurality of sections including at least a cold pass bank economizer and a hot pass bank economizer, and wherein the cold pass bank and the hot pass bank are positioned in a parallel arrangement relative to the gas flow such that each bank receives a different portion of the stream of heated flue gas; wherein the cold pass bank economizer and the hot pass bank economizer each comprise at least one collection header and a plurality of mini-headers connected to each collection header; a water coil air heater positioned outside of the cavity and adapted for transferring heat from a flow of feedwater flowing inside the water coil air heater to a stream of air outside of the water coil air heater; a feedwater inlet for receiving the flow of feedwater into the economizer arrangement from outside the cavity; a feedwater outlet for the flow of feedwater exiting the economizer arrangement; and at least one valve adapted including for controlling the path of the flow of feedwater between the cold pass bank economizer and the water coil air heater; wherein the economizer arrangement is adapted to route the flow of feedwater from the feedwater inlet, thence to the cold pass bank economizer, thence outside the cavity to the water coil air heater, thence back into the cavity into the hot pass bank economizer, and thence to the feedwater outlet and out of the economizer arrangement.

Accordingly, another embodiment of the present invention is drawn to an economizer arrangement comprising: a cavity for conveying heated gas flow, the cavity having a first economizer side wall and a second economizer side wall; the cavity having an upstream direction which receives a stream of heated gas flow and a downstream direction for exiting gas flow; an economizer bank stretching substantially from the first economizer side wall to the second economizer side wall, the economizer bank comprising a plurality of sections including at least a cold pass bank economizer and a hot pass bank economizer, and wherein the cold pass bank and the hot pass bank are positioned in an arrangement such that each bank receives a different portion of the stream of heated gas flow; a water coil air heater positioned outside of the cavity and adapted for transferring heat from a flow of feedwater flowing inside the water coil air heater to a stream of air outside of the water coil air heater; wherein the economizer arrangement is adapted to route the flow of feedwater into the cold pass bank economizer, thence outside the cavity to the water coil air heater, thence back into the cavity into the hot pass bank economizer, and thence out of the economizer arrangement.

In one aspect of the arrangement, the cold pass bank and the hot pass bank each comprise at least one collection header and a plurality of mini-headers connected to each collection header.

A water coil air heater is positioned outside of the cavity and adapted for transferring heat from a flow of feedwater flowing inside the water coil air heater to a stream of air outside of the water coil air heater.

A feedwater inlet is provided for receiving the flow of feedwater into the economizer arrangement and a feedwater outlet is provided for the flow of feedwater exiting the economizer arrangement. At least one valve is adapted including for controlling the path of the flow of feedwater, such as between the cold pass bank and the water coil air heater.

The economizer arrangement is adapted to route a flow of feedwater from the feedwater inlet, then to the cold pass bank, then outside the economizer arrangement to the water coil air heater, then back into the economizer arrangement to the hot pass bank, and finally to the feedwater outlet and out of the economizer arrangement.

The economizer arrangement may be part of any boiler arrangement including a process recovery boiler or any other second boiler.

The various features of novelty and other non-limiting aspects and/or objects of the disclosure which characterize the invention are pointed out with particularity below and in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

The following is a brief description of the drawings, which are presented for the purposes of illustrating the exemplary embodiments disclosed herein, where like reference numbers are used to refer to the same or functionally similar elements and not for the purposes of limiting the same.

DESCRIPTION OF THE INVENTION

Figure 1:
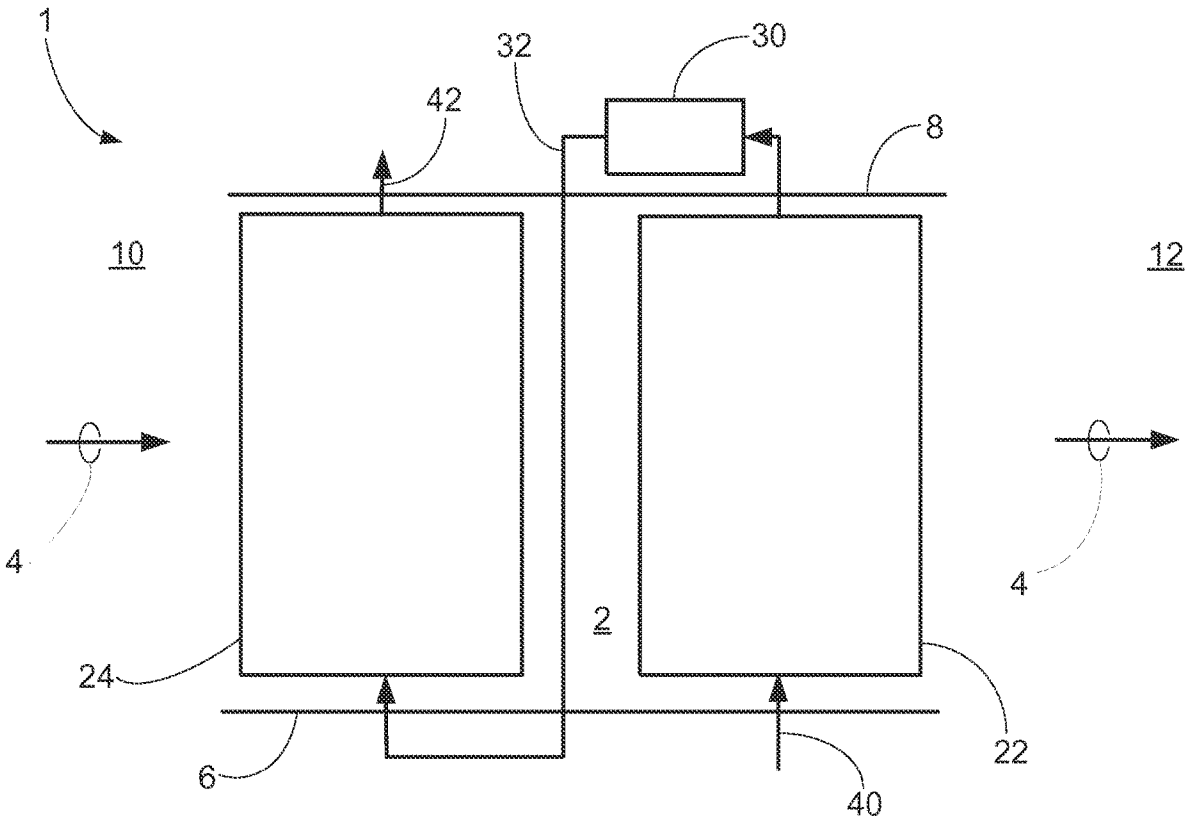
FIG. 1 Prior Art
FIG. 1 is a schematic view of a prior art arrangement comprising separate hot and cold economizer banks in series and a water coil air heater.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

It should be noted that many of the terms used herein are relative terms. For example, the terms "inlet" and "outlet" are relative to a direction of flow, and should not be construed as requiring a particular orientation or location of the structure.

To the extent that explanations of certain terminology or principles of the steam generating arts may be necessary to understand the present disclosure, the reader is referred to *Steam/its generation and use,* 41st Edition, Kitto and Stultz, Eds., Copyright ©2005, The Babcock & Wilcox Company, the text of which is hereby incorporated by reference as though fully set forth herein.

Figure 4:
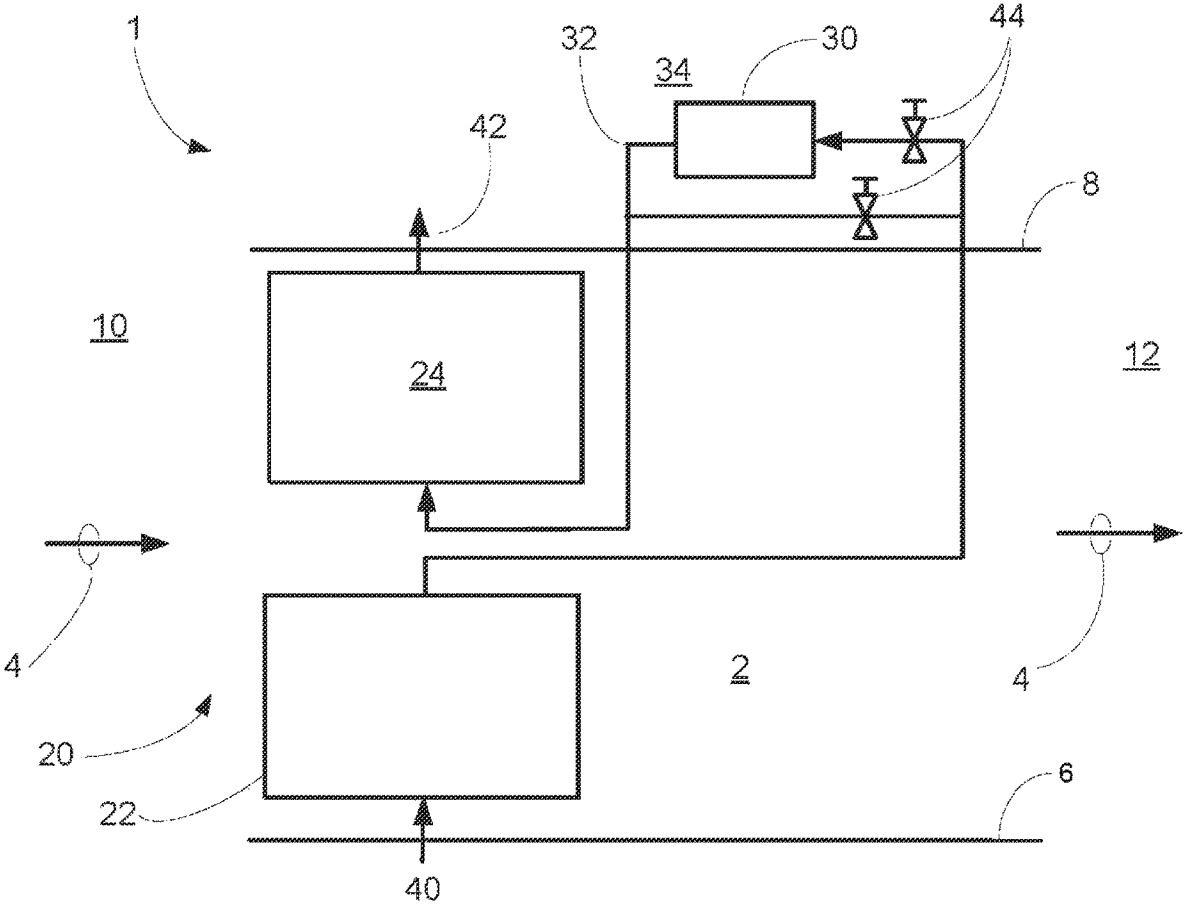
FIG. 4 is a schematic view of a split bank economizer arrangement in parallel of the present arrangement.

Referring now to the drawings, FIG. 4 is a schematic diagram of a preferred boiler economizer arrangement 1 embodying the invention.

The economizer arrangement 1 will typically be part of a larger arrangement for capturing heat energy from a flowing gas and transferring it to another flowing substance for use in power generation. This may be capturing furnace combustion heat from hot flue gas. Preferably, the economizer arrangement 1 is located in the path of moving heated flue gas flow 4 downstream from other heat absorbing equipment, such as superheaters, which will have partially cooled the flue gas flow 4 by the time it reaches the economizer. However, the present invention is not limited to economizer arrangements which are physically part of the boiler and furnace combustion equipment, and alternatively may be a separately located arrangement of an economizer at the plant.

The heated flue gas is conveyed from the heat source down a path which may include the first economizer side and second economizer side walls 6, 8, respectively. As used herein, the term economizer side wall refers to enclosure walls which convey the flue gas and which surround the economizer arrangement 1. These enclosure walls are typically casing, but may be comprised of heating surface, conveying water, steam, or mixtures thereof. The path of the flue gas flow 4 may be generically referred to as a cavity 2 for conveying heated flue gas. Cavity 2 may also be referred to as an "enclosure" which conveys the heated flue gas. Preferably, the cavity 2 is defined by a first economizer side wall 6 and a second economizer side wall 8, with the first and second economizer side walls being opposite each other. The flue gas path may be a single continuous cavity, or it may split or branch as needed. The cavity 2 has an upstream direction 10 where heated flue gas comes from, often being the direction where combustion or other heat-generating reaction takes place. The cavity also has a downstream direction 12 that eventually leads to an opening to atmosphere. The cavity 2 will often be rectangular in cross section but is not limited to any particular shape.

An economizer bank 20 stretches substantially from a first economizer side wall 6 to a second economizer side wall 8. Preferably the economizer bank takes up most or all of a cross-section of the cavity 2 so that a maximum portion of the passing flue gas flow 4 is forced to contact the bank for maximum heat transfer. The economizer bank includes at least two banks, typically including a cold pass bank economizer 22 where feedwater transits first, and a hot pass bank economizer 24 where the feedwater transits later. Preferably, the cold pass bank economizer 22 and the hot pass bank economizer 24 are positioned in a parallel arrangement relative to the flue gas flow 4 to collectively span substantially across the width of the cavity 2 as shown, for example, in FIGS. 4-5. Similar arrangements using more than two banks are possible. Different shapes and arrangements can be used without departing from the general concept of filling a single cross-section of the cavity with more than one separate pass bank for heat transfer. The pass banks may be of equal size, or of different sizes.

Figure 2:
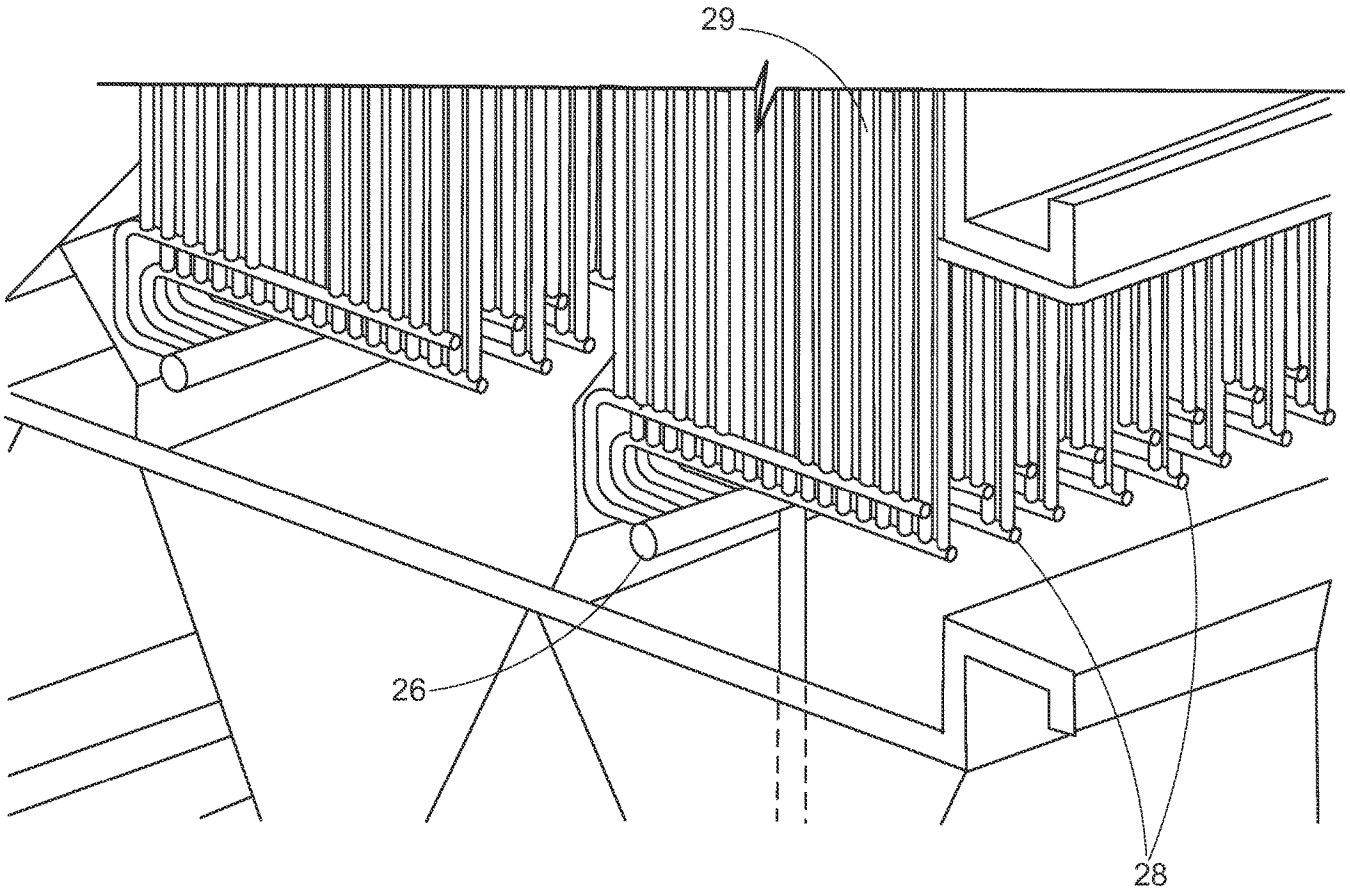
FIG. 2 Prior Art
FIG. 2 is a perspective drawing of a bottom portion of a prior art economizer bank.
Figure 3:
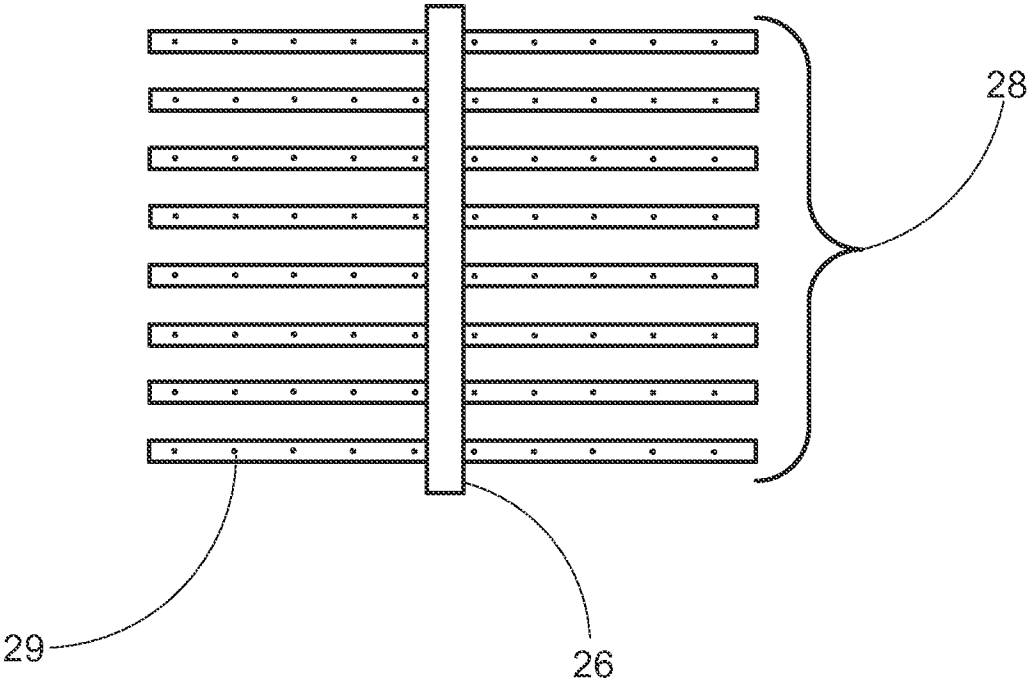
FIG. 3 Prior Art
FIG. 3 is a plan view diagram of a prior art economizer cold bank.
Figure 5:
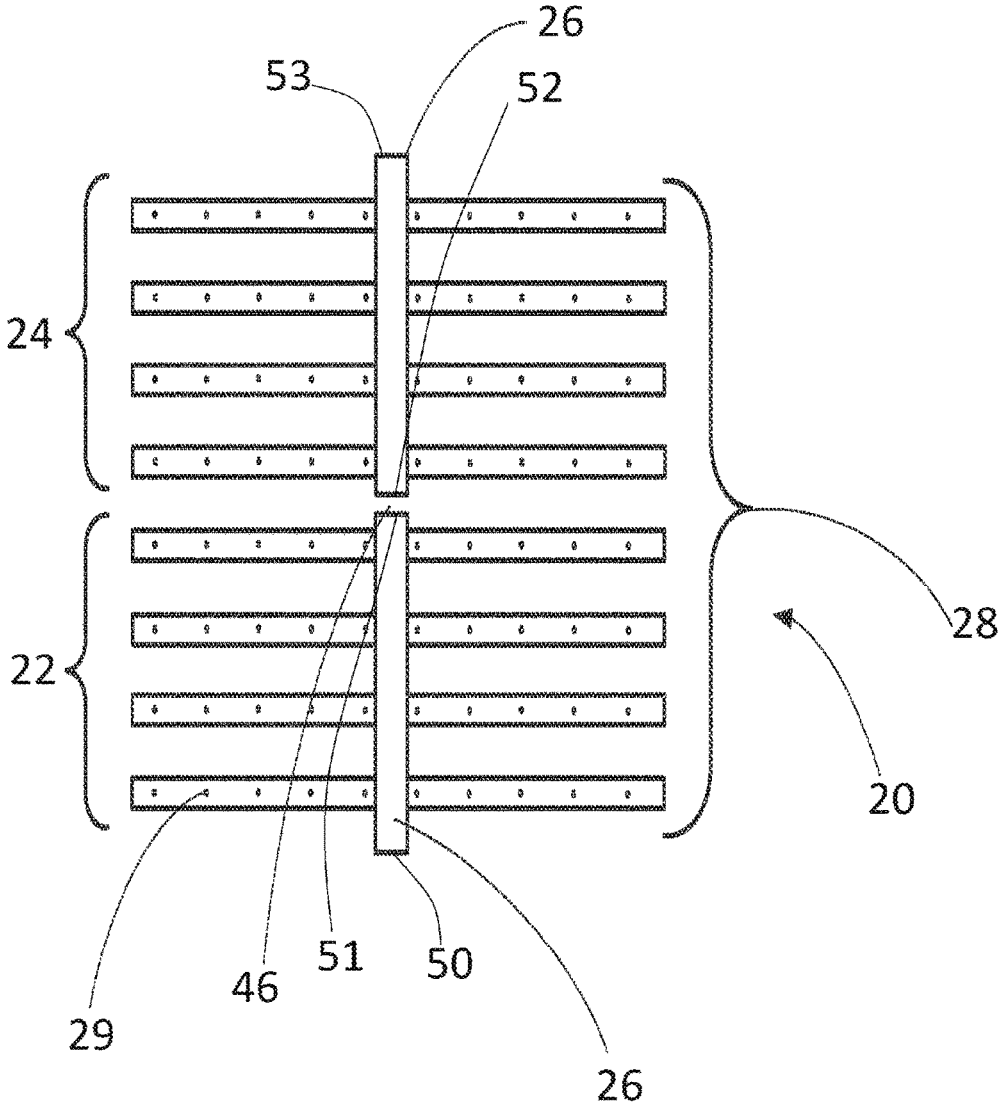
FIG. 5 is a plan view of a split bank economizer bank of the present arrangement.

In a preferred embodiment each cold pass bank economizer 22 and hot pass bank economizer 24 includes at least one collection header 26 and a plurality of mini-headers 28 connected to each collection header 26. There may be one hot pass split collection header 26 for the hot pass bank economizer 24 and one cold pass split collection header 26 for the cold pass bank economizer 22. As shown in FIG. 5, the cold pass split collection header 26 extends from end 50 to end 51. The hot pass split collection header 26 extends from end 52 to end 53. Collection header split 46 is defined at a location between end 51 and end 52. Each mini-header may in turn be connected to a number of pipes or tubes 29. See, generally, FIG. 5 in light of FIG. 2. Many other economizer designs may be used with the arrangement, however, to maximize the surface area available for heat transfer from the flue gas flow 4 to the feedwater 32. The general principle is that feedwater enters each economizer bank through preferably one opening, then spreads out through a network of (typically branching, winding, and/or having heat-conducting protrusions) pipes and tubes to increase surface area and residence time in the heated zone, and then consolidates back down to preferably another single opening which routes warmed feedwater out of the economizer bank.

One aspect of the invention is that a water coil air heater 30 ("WCAH") is positioned in the flow path for the feedwater 32 upstream of at least one hot pass bank economizer 24 and downstream of at least one cold pass bank economizer 22. The WCAH 30 will typically need to be positioned outside of the cavity 2 containing the flow of heated flue gas flow 4, preferably in a stream of cooler air which may be routed into the a furnace. This is so that some heat will be transferred back out of the newly-warmed feedwater 32, via the WCAH 30, and into the stream of cooler air. After the feedwater is cooled in the WCAH 30, it proceeds to another pass bank economizer 24 to be heated again by the flue gas flow 4. Various embodiments of this general concept, such as alternating three or more pass banks with two or more WCAHs, are possible. The WCAH can take a number of forms, and the arrangement is not limited to a particular type of WCAH.

The economizer arrangement 1 preferably includes at least one feedwater inlet 40 for receiving water into the economizer arrangement. The feedwater inlet 40 may lead to an economizer pass bank. The arrangement also preferably includes at least one heated water outlet 42 for water flow exiting the economizer arrangement 1.

Preferably, the economizer arrangement includes at least one valve 44 for controlling a flow of water between the cold bank economizer 22 and the water coil air heater 30. Valves 44 might be adapted for biasing feedwater flow between economizer banks (22, 24), and for either routing water into a WCAH 30 or bypassing a WCAH 30.

In the illustrative embodiments, feedwater 32 enters the economizer arrangement 1 at the feedwater inlet 40. The feedwater proceeds through the cold bank economizer 22 where it flows through a branching series of header(s), mini-headers, and tubes which have a large collective surface area. Heat is transferred from the flowing flue gas flow 4 to the feedwater 32 through the surfaces of the cold bank economizer 22. The feedwater converges again, typically in a header, and leaves the cold bank economizer. The feedwater then proceeds via a pipe out of the second economizer side wall 8 of the cavity 2, through an open valve 44, and into a WCAH 30. In the WCAH 30 the feedwater sheds some heat energy into a passing stream of air 34. The cooled feedwater then flows out of the WCAH 30, back into the cavity 2 and into the hot bank economizer 24. The feedwater is heated again by the hot gas flow 4 through the branching flow paths of the hot bank economizer 24 similar to the cold bank economizer 22. The reheated water then proceeds out of the enclosure via an outlet 42 and eventually to a drum (in recirculating boilers) or furnace surface (once-through boilers).

TABLE 1

Prior Art Long Flow (mini-header) Economizer vs. Side-by-Side Long Flow (mini-header) Economizer

| | | Prior Art Economizer | Parallel Economizer, (50:50 hot:cold split) | |
|---|---|---|---|---|
| Economizer Height | ft | 42 | 42 | 100 |
| Subcooling Lvg Econ | ° F. | 27 | 101 | 40 |
| Gas temperature leaving | ° F. | 588 | 576 | 430 |

Table 1 illustrates that a multiple gas path, parallel (with an intermediate WCAH) economizer (with hot and cold pass banks in parallel relative to the gas flow) provides an additional 70+ degrees of subcooling over a similar sized conventional economizer arrangement (with two 42 ft economizer columns—hot and cold pass banks in series relative to the gas flow). With this additional subcooling, the economizer heating surface can be increased while maintaining steaming economizer design margins. Table 1 shows that a 100 ft tall economizer bank (far right column) can achieve low economizer exit gas temperatures (EEGT) while still maintaining 40 F subcooling. Thus, the current arrangement both improves economizer performance and lowers costs.

The arrangement is particularly useful for retrofitting older installations where space is fixed and limited, but where the efficiency advantages of a WCAH are desired.

For example, the arrangement could be applied successfully in process recovery (PR) boilers undergoing low odor conversions. Environmental regulations are driving low odor conversions in the existing direct contact evaporator recovery boiler fleet. A recovery boiler is used in the Kraft process of wood pulping where chemicals for white liquor are recovered and reformed from black liquor, which contains lignin from previously processed wood. The black liquor is burned, generating heat, which is usually used in the pulping process or in making electricity, much as in a conventional steam power plant. When a low odor conversion of a pulping facility is completed, the direct contact evaporators are replaced with multiple effect evaporators. As a result of this change, the flue gas temperature leaving the unit no longer needs to be 600+ degrees F. Typically, to re-gain efficiency on low odor conversions, gas temperature is reduced by the addition of economizer surface. The multi-gas path arrangement with an intermediate WCAH of the present arrangement increases efficiency over that which is possible with traditional single or multiple bank longflow economizer arrangements.

Additionally, the multi-gas path economizer arrangement could be applied to other types of boilers, including but not limited to waste-to-energy applications and biomass combustion technologies.

The multi-gas path parallel economizer banks design brings a number of advantages. The arrangement achieves higher heat absorption rates within a single long flow bank than were previously possible. It was previously necessary to add a second full flow bank in series (with respect to gas flow as in FIG. 1) in order use a WCAH and thereby to more efficiently cool flue gas. The arrangement includes the flexibility to define shapes and relative sizes of the cold and hot pass heating surfaces. The location of a collection header split 46 can be tailored to maximize unit performance (see FIG. 5).

The integration of economizers to a WCAH 30 allows the biasing of water between the components, including by using valves 44. The arrangement has the capability to control gas temperature leaving the economizer, water temperature leaving the economizer, and/or air temperature leaving the water coil air heater.

The arrangement could also be implemented, for example, using a horizontal flow continuous tube economizer instead of long flow-mini header type economizer banks. A continuous tube economizer could be split with intermediate headers which leave a cavity 2, bring feedwater to a WCAH 30, and then return cooled feedwater to the continuous tube economizer.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

We claim:

1. A boiler economizer arrangement comprising:

a single cavity for conveying heated flue gas flow, the single cavity including a first economizer side wall and a second economizer side wall, wherein the first and second economizer side walls are opposite each other to define the single cavity therebetween;

the single cavity having an upstream direction which receives a stream of heated flue gas flow, and a downstream direction for exiting flue gas;

an economizer bank stretching substantially from the first economizer side wall to the second economizer side wall, the economizer bank comprising a cold pass bank economizer and a hot pass bank economizer, and wherein the cold pass bank and the hot pass bank are positioned in a parallel arrangement relative to the stream of heated flue gas such that each bank receives a different portion of the stream of heated flue gas;

a split collection header comprising a hot pass split collection header for the hot pass bank economizer, a cold pass split collection header for the cold pass bank economizer, the cold pass split collection header extending between a first end and a second end, the hot pass split collection header extending between a third end and a fourth end, and a split at a location between the second end and the third end cold pass split collection header and the hot pass split collection header, said location being within the single cavity such that a portion of the stream of heated flue gas passes through the split;

a water coil air heater positioned outside of the cavity and adapted for transferring heat from a flow of feedwater flowing inside the water coil air heater to a stream of air outside of the water coil air heater; a feedwater inlet for receiving the flow of feedwater into the economizer arrangement from outside the cavity;

a feedwater outlet for the flow of feedwater exiting the economizer arrangement; and at least one valve adapted for controlling the flow of feedwater between the cold pass bank economizer and the water coil air heater;

wherein the economizer arrangement is adapted to route the flow of feedwater from the feedwater inlet, then to the cold pass bank economizer, then outside the cavity to the water coil air heater, then back into the cavity into the hot pass bank economizer, and then to the feedwater outlet and out of the economizer arrangement;

wherein the flow of feedwater is routed away from the economizer bank to the water coil air heater at the split between the cold pass split collection header and the hot pass split collection header; and wherein the cold pass bank economizer and the hot pass bank economizer are connected in series relative to the flow of feedwater.

2. The economizer arrangement of claim 1, wherein the cold pass bank economizer is adjacent to the first economizer side wall and the hot pass bank economizer is adjacent to the second economizer side wall.

3. An economizer arrangement comprising:

a single cavity for conveying heated gas flow, the single cavity having a first economizer side wall and a second economizer side wall to define the single cavity therebetween;

the single cavity having an upstream direction which receives a stream of heated gas and a downstream direction for exiting gas flow;

an economizer bank stretching substantially from the first economizer side wall to the second economizer side wall, the economizer bank comprising a plurality of sections including at least a cold pass bank economizer and a hot pass bank economizer, and wherein the cold pass bank and the hot pass bank are positioned in a parallel arrangement such that each bank receives a different portion of the stream of heated gas;

a split collection header comprising a hot pass split collection header for the hot pass bank economizer, a cold pass split collection header for the cold pass bank economizer, and a split at a location between the cold pass split collection header and the hot pass split collection header, said location being within the single cavity such that a portion of the stream of heated gas passes through the split;

a water coil air heater positioned outside of the cavity and adapted for transferring heat from a flow of feedwater flowing inside the water coil air heater to a stream of air outside of the water coil air heater;

wherein the economizer arrangement is adapted to route the flow of feedwater into the cold pass bank economizer, then outside the cavity to the water coil air heater, then back into the cavity into the hot pass bank economizer, and then out of the economizer arrangement;

wherein the flow of feedwater is routed away from the economizer bank to the water coil air heater at the split between the cold pass split collection header and the hot pass split collection header; and wherein the cold pass bank economizer and the hot pass bank economizer are connected in series relative to the flow of feedwater.

4. The economizer arrangement of claim 3, further comprising: a feedwater inlet for receiving the flow of feedwater entering the economizer arrangement; and a feedwater outlet for the flow of feedwater exiting the economizer arrangement.

5. The economizer arrangement of claim 3, wherein the water coil air heater is adapted to warm the stream of air on its way to a furnace.

6. The economizer arrangement of claim 3, further comprising at least one valve adapted for controlling the flow of feedwater including between the cold pass bank economizer and the water coil air heater.

7. The economizer arrangement of claim 3, wherein the single cavity is part of a boiler, and wherein the first economizer side wall and the second economizer side wall are directly opposite each other.

8. The economizer arrangement of claim 7, wherein the cold pass bank economizer is adjacent to the first side wall and the hot pass bank economizer is adjacent to the second side wall.

* * * * *